US010060118B2

(12) United States Patent
Callahan et al.

(10) Patent No.: US 10,060,118 B2
(45) Date of Patent: Aug. 28, 2018

(54) SYSTEMS, DEVICES, AND/OR METHODS FOR MANAGING DECK INSTALLATION

(71) Applicants: Robert M. Callahan, Boones Mill, VA (US); Shawn A. Callahan, Blue Ridge, VA (US)

(72) Inventors: Robert M. Callahan, Boones Mill, VA (US); Shawn A. Callahan, Blue Ridge, VA (US)

( * ) Notice: Subject to any disclaimer, the term of this patent is extended or adjusted under 35 U.S.C. 154(b) by 0 days.

(21) Appl. No.: 15/488,912

(22) Filed: Apr. 17, 2017

(65) Prior Publication Data

US 2017/0298611 A1 Oct. 19, 2017

Related U.S. Application Data

(60) Provisional application No. 62/323,779, filed on Apr. 17, 2016.

(51) Int. Cl.

| | |
|---|---|
| ***E04H 12/00*** | (2006.01) |
| ***E04B 1/00*** | (2006.01) |
| *E04B 1/24* | (2006.01) |
| *E04B 1/26* | (2006.01) |

(52) U.S. Cl.
CPC ..... *E04B 1/003* (2013.01); *E04B 1/2612* (2013.01); *E04B 2001/2415* (2013.01)

(58) Field of Classification Search
CPC ..... E04B 1/2403; E04B 1/003; E04B 1/185; E04B 1/1903; E04B 2001/2406; E04B 2001/2415; E04B 2001/1993; E04B 2001/2418; E04B 2001/2421; E04B 5/12; E04B 2001/405; E04C 3/14
See application file for complete search history.

(56) References Cited

U.S. PATENT DOCUMENTS

| | | | | |
|---|---|---|---|---|
| 6,295,781 | B1 * | 10/2001 | Thompson | E04B 1/2608 403/232.1 |
| 7,634,889 | B1 * | 12/2009 | diGirolamo | E04B 1/2403 403/232.1 |
| 2008/0256884 | A1 * | 10/2008 | Clarizia | E04B 1/2612 52/309.3 |
| 2017/0044752 | A1 * | 2/2017 | Higginbotham | E04B 1/003 |
| 2017/0175377 | A1 * | 6/2017 | LoFranco | E04B 1/2403 |

* cited by examiner

*Primary Examiner* — Brian D Mattei
(74) *Attorney, Agent, or Firm* — Dale Jensen; Dale Jensen, PLC

(57) ABSTRACT

Certain exemplary embodiments can provide deck bracket, which comprises a bracket face. The bracket face is substantially planar and defines a first plane. The deck bracket comprises a first bracket wall and a second bracket wall, each of which directly contact the bracket face. The deck bracket comprises a first bracket flange that directly contacts the first bracket wall and a second bracket flange that directly contacts the second bracket wall.

5 Claims, 10 Drawing Sheets

2000

SYSTEMS, DEVICES, AND/OR METHODS FOR MANAGING DECK INSTALLATION

CROSS-REFERENCES TO RELATED APPLICATIONS

This application claims priority to, and incorporates by reference herein in its entirety, U.S. Provisional Patent Application Ser. No. 62/323,779, filed Apr. 17, 2016.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide deck bracket, which comprises a bracket face. The bracket face is substantially planar and defines a first plane. The deck bracket comprises a first bracket wall and a second bracket wall, each of which directly contact the bracket face. The deck bracket comprises a first bracket flange that directly contacts the first bracket wall and a second bracket flange that directly contacts the second bracket wall.

Figure 1:
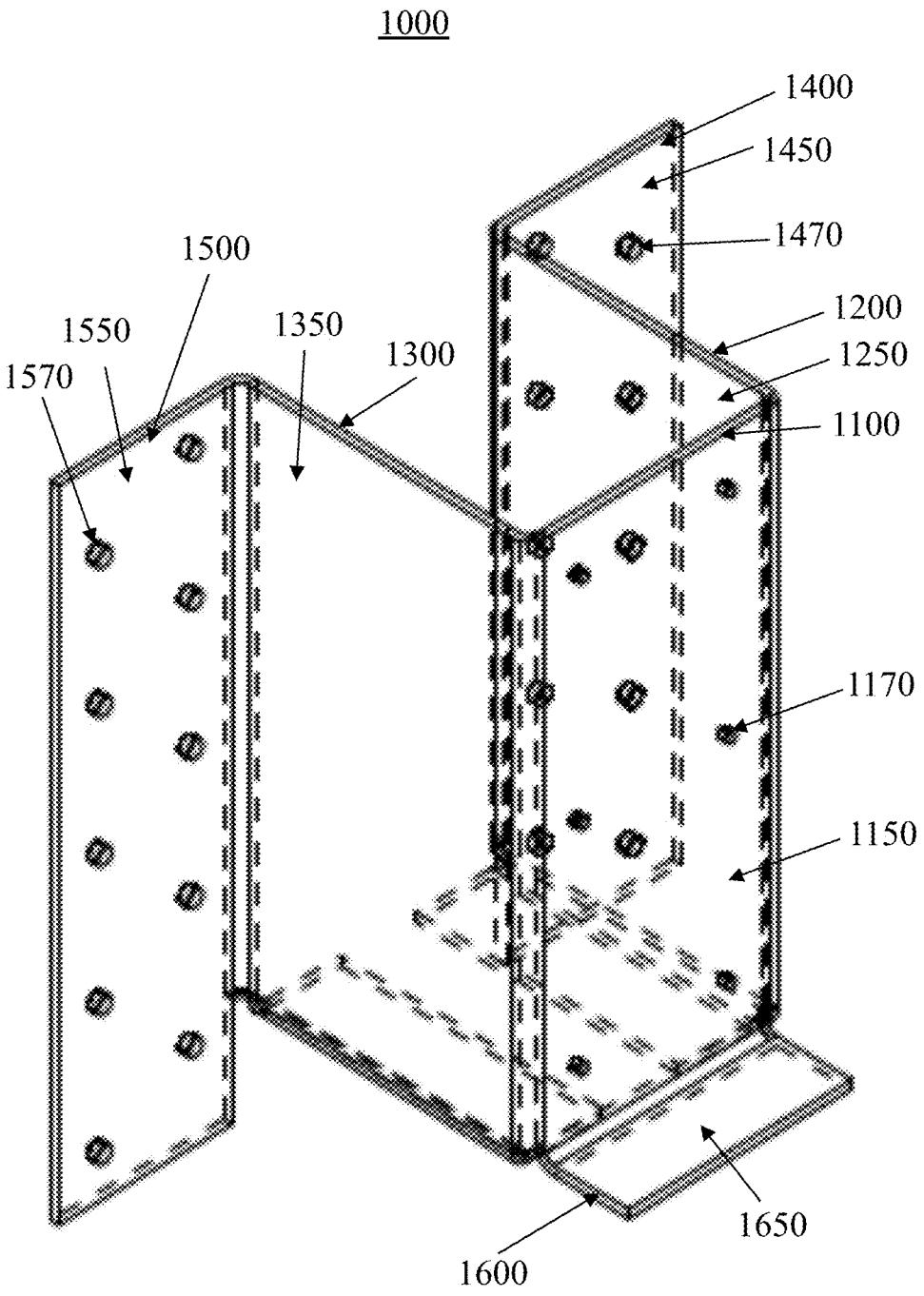
FIG. 1 is a perspective view of a transparent rendition of an exemplary embodiment of a deck bracket 1000.

FIG. 1 is a perspective view of a transparent rendition of an exemplary embodiment of a deck bracket 1000, which comprises a bracket face 1100. Bracket face 1100 is substantially planar and defines a first plane 1150. Bracket face 1100 defines a first plurality of apertures 1170.

Deck bracket 1000 comprises a first bracket wall 1200 that directly contacts bracket face 1100. First bracket wall 1200 is substantially planar and defines a second plane 1250. First bracket wall 1200 can lack apertures. First plane 1150 is substantially perpendicular to second plane 1250.

Deck bracket 1000 comprises a second bracket wall 1300 that directly contacts bracket face 1100. Second bracket wall 1300 is substantially planar and defines a third plane 1350. Second bracket wall 1300 can lack apertures. First plane 1150 is substantially perpendicular to third plane 1350.

Deck bracket 1000 comprises a first bracket flange 1400 that directly contacts first bracket wall 1200. First bracket flange 1400 is substantially planar and defines a fourth plane 1450. First bracket flange 1400 defines a second plurality of apertures 1470. Fourth plane 1450 is substantially perpendicular to second plane 1250.

Deck bracket 1000 comprises a second bracket flange 1500 that directly contacts second bracket wall 1300. Second bracket flange 1500 is substantially planar and defines a fifth plane 1550. Second bracket flange 1500 defines a third plurality of apertures 1570. Fifth plane 1550 is substantially perpendicular to third plane 1350.

Deck bracket 1000 comprises a supporting lip 1600 that directly contacts bracket face 1100. Supporting lip 1600 is substantially planar and defines a sixth plane 1650. Supporting lip 1600 can lack apertures. First plane 1150 is substantially perpendicular to sixth plane 1650.

Figure 7:
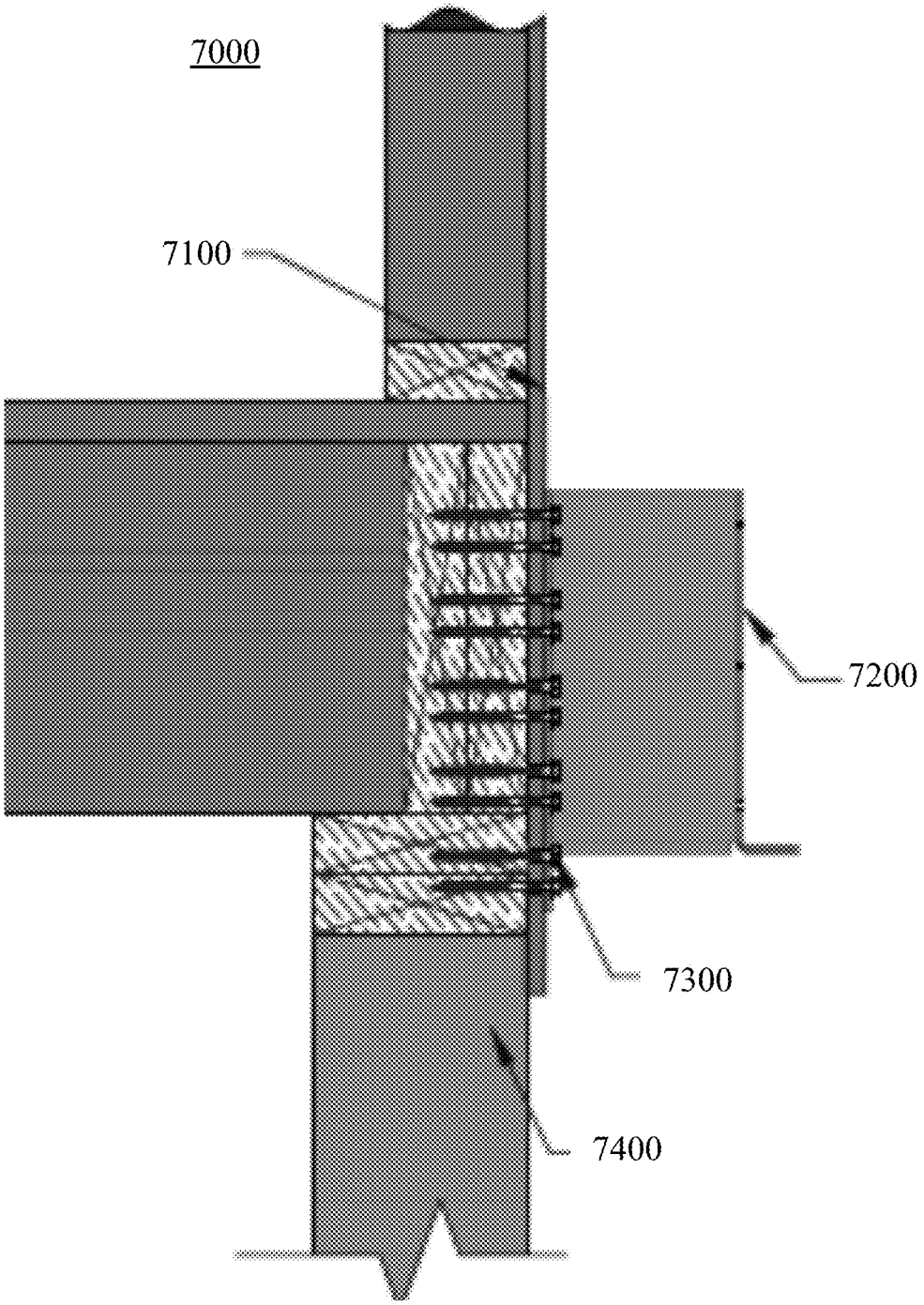
FIG. 7 is an sectional view of an exemplary embodiment of a system 7000.

In certain exemplary embodiments, deck bracket 1000 can be coupled to (or constructed to be coupled to) a deck sheath (e.g., deck sheath 7100 of FIG. 7). The deck sheath is coupleable to deck bracket 1000 via fasteners engaged with the deck sheath through second plurality of apertures 1470 and third plurality of apertures 1570.

Figure 9:
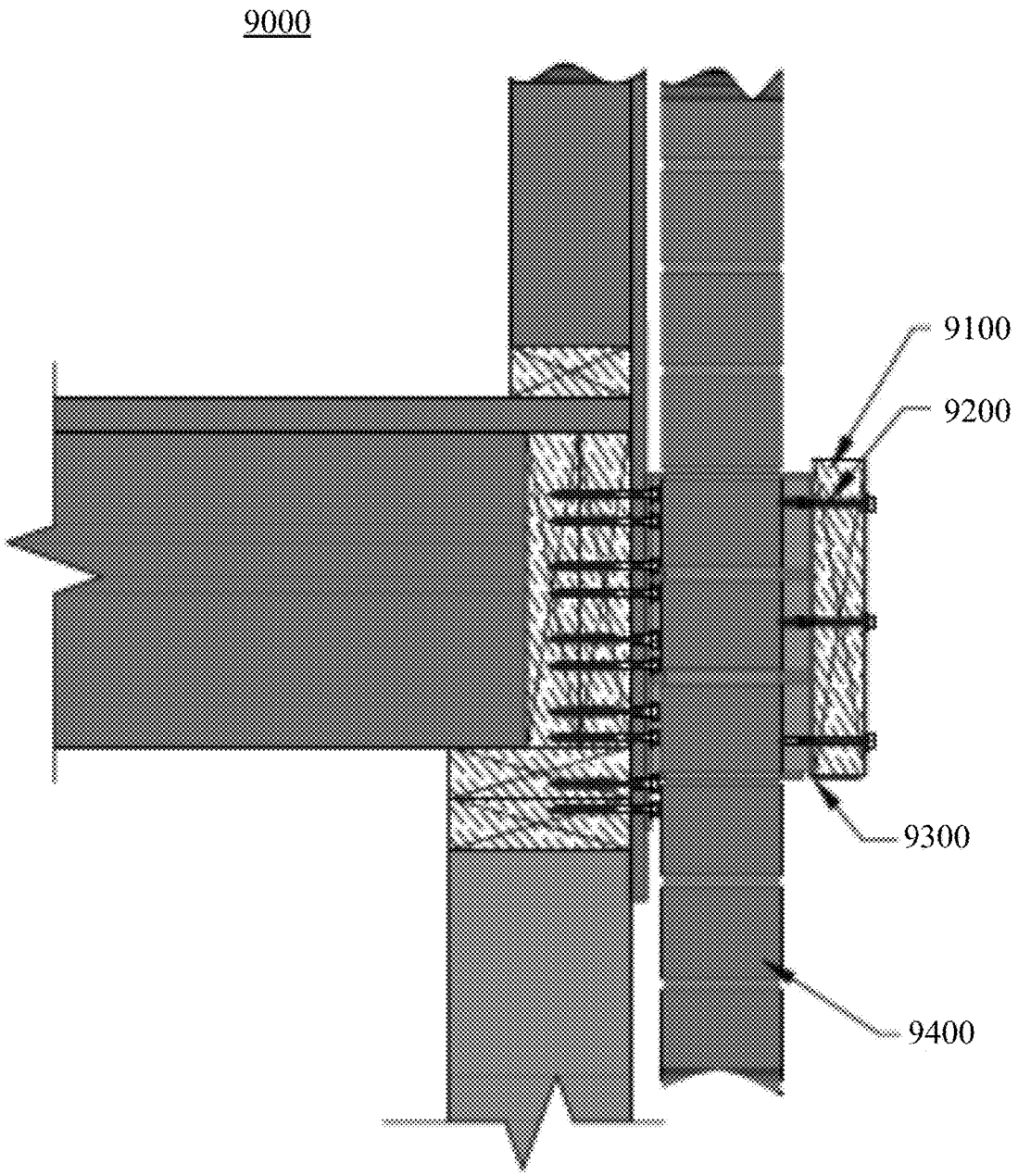
FIG. 9 is a sectional view of an exemplary embodiment of a system 9000.

In certain exemplary embodiments, deck bracket 1000 can be coupled to a deck band e.g., deck band 9100 of FIG. 9). The deck band is coupleable to deck bracket 1000 via fasteners engaged with the deck band through first plurality of apertures 1170, wherein supporting lip 1600 is constructed to support an edge of the deck band.

Figure 2:
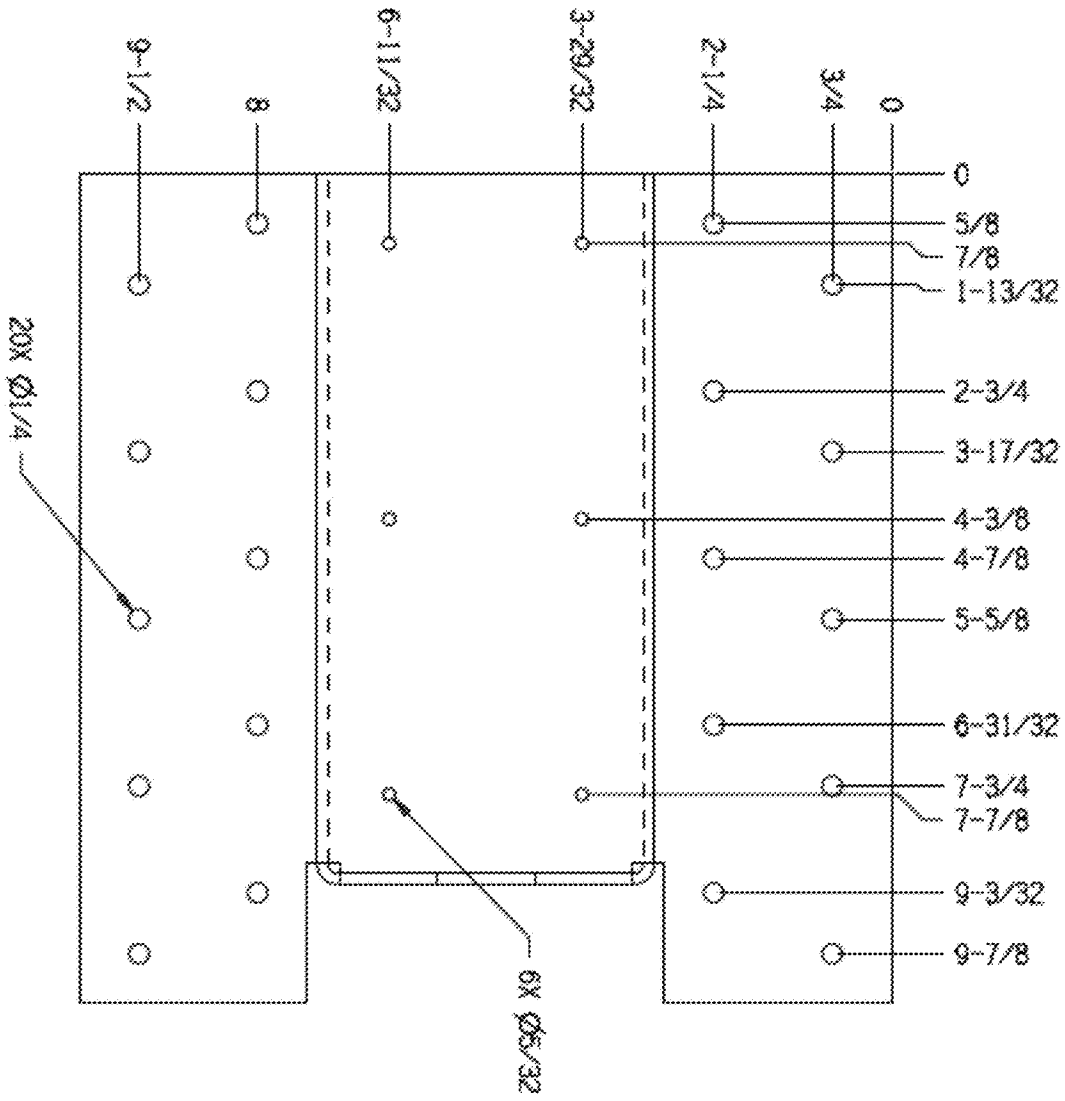
FIG. 2 is an end view of an exemplary embodiment of a system 2000.

FIG. 2 is an end view of an exemplary embodiment of a system 2000, which illustrates aperture distances and diameters. The dimensions shown on the drawing are for a particular embodiment and those skilled in the art will recognize that other embodiments with different dimensions are possible within the scope of the subject matter disclosed herein.

Figure 3:
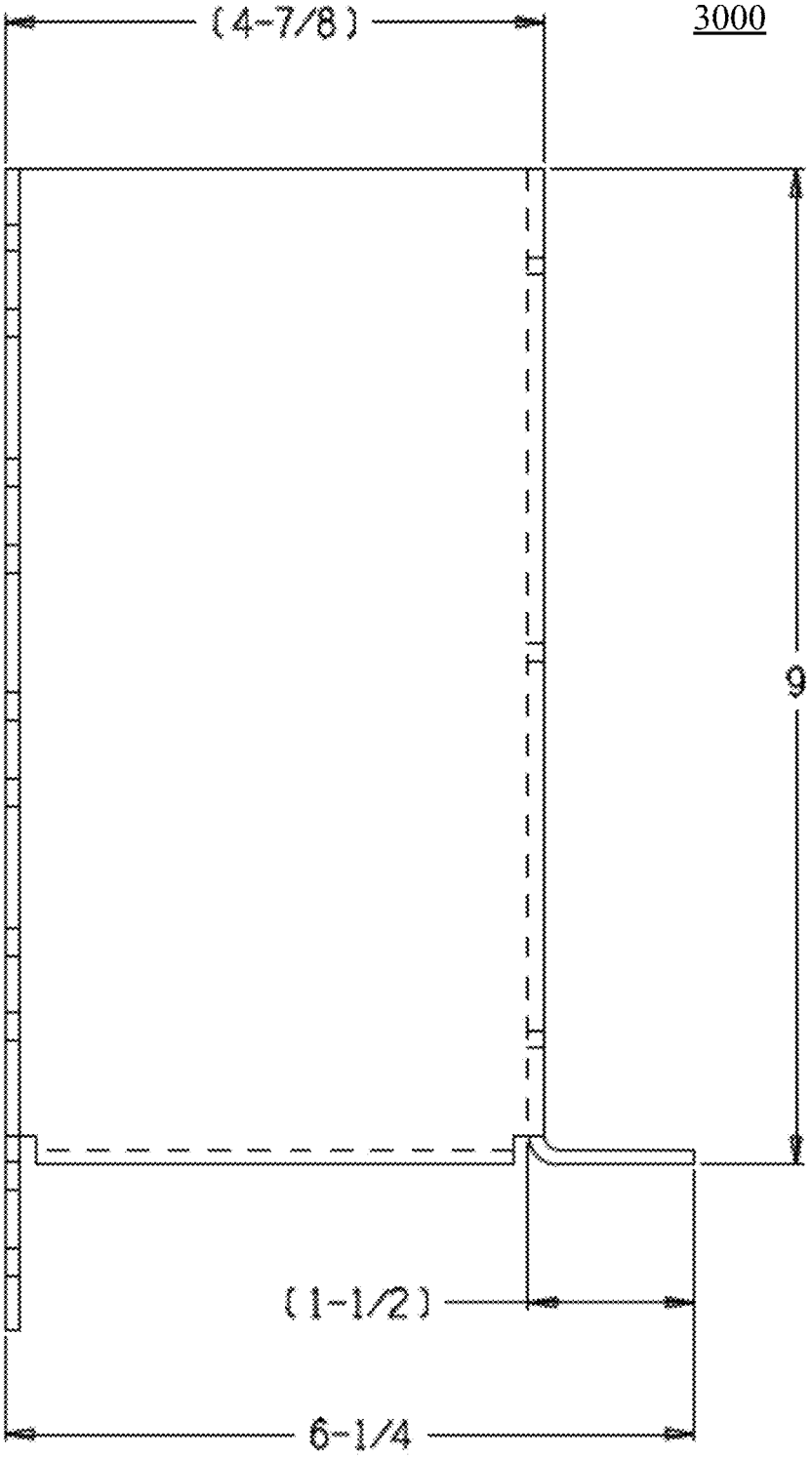
FIG. 3 is a side view of an exemplary embodiment of a system 3000.

FIG. 3 is a side view of an exemplary embodiment of a system 3000, which illustrates dimensions. The dimensions shown on the drawing are for a particular embodiment and those skilled in the art will recognize that other embodiments with different dimensions are possible within the scope of the subject matter disclosed herein.

Figure 4:
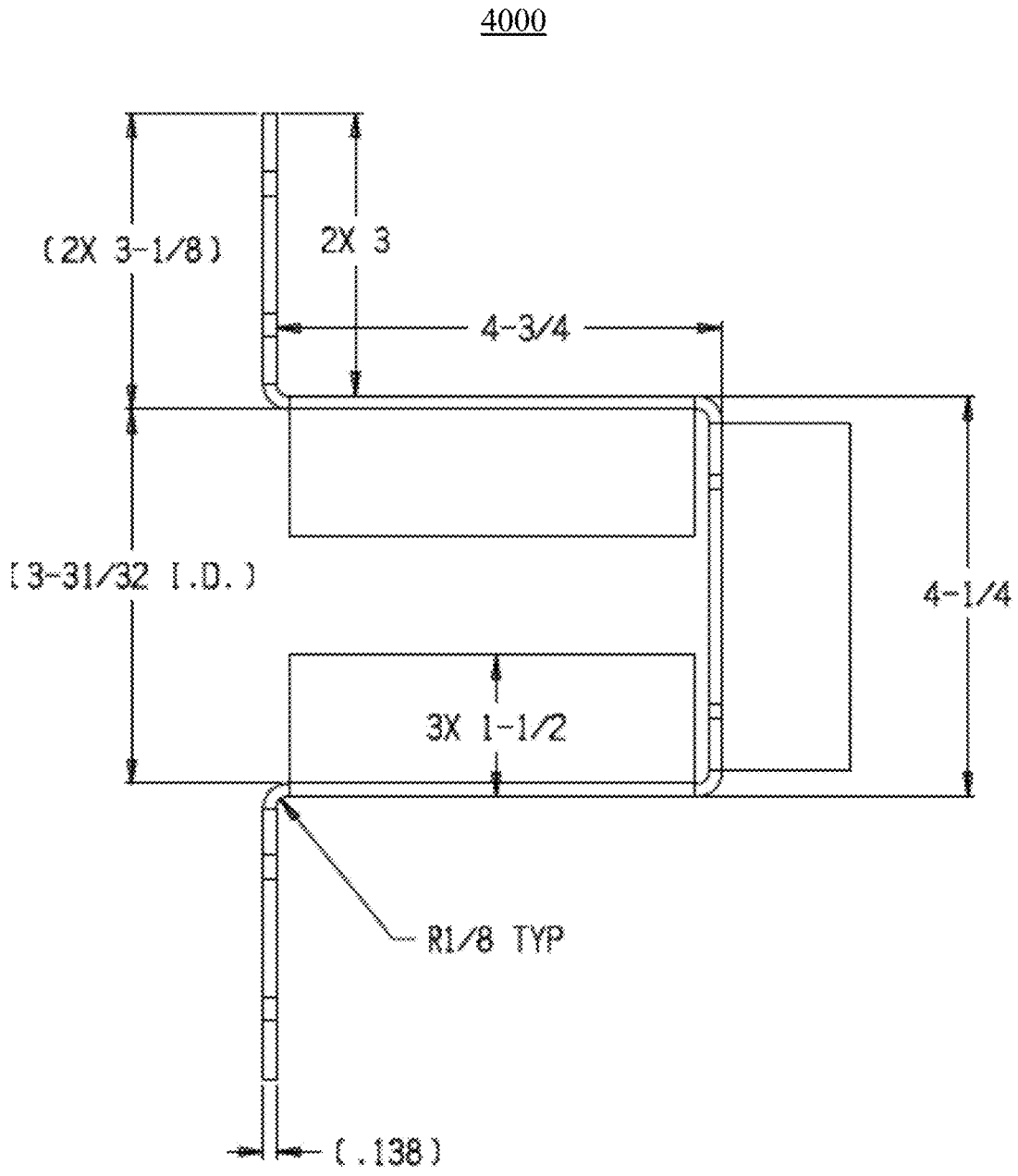
FIG. 4 is a plan view of an exemplary embodiment of a system 4000.

FIG. 4 is a plan view of an exemplary embodiment of a system 4000, which illustrates dimensions. The dimensions shown on the drawing are for a particular embodiment and those skilled in the art will recognize that other embodiments with different dimensions are possible within the scope of the subject matter disclosed herein.

Figure 5:
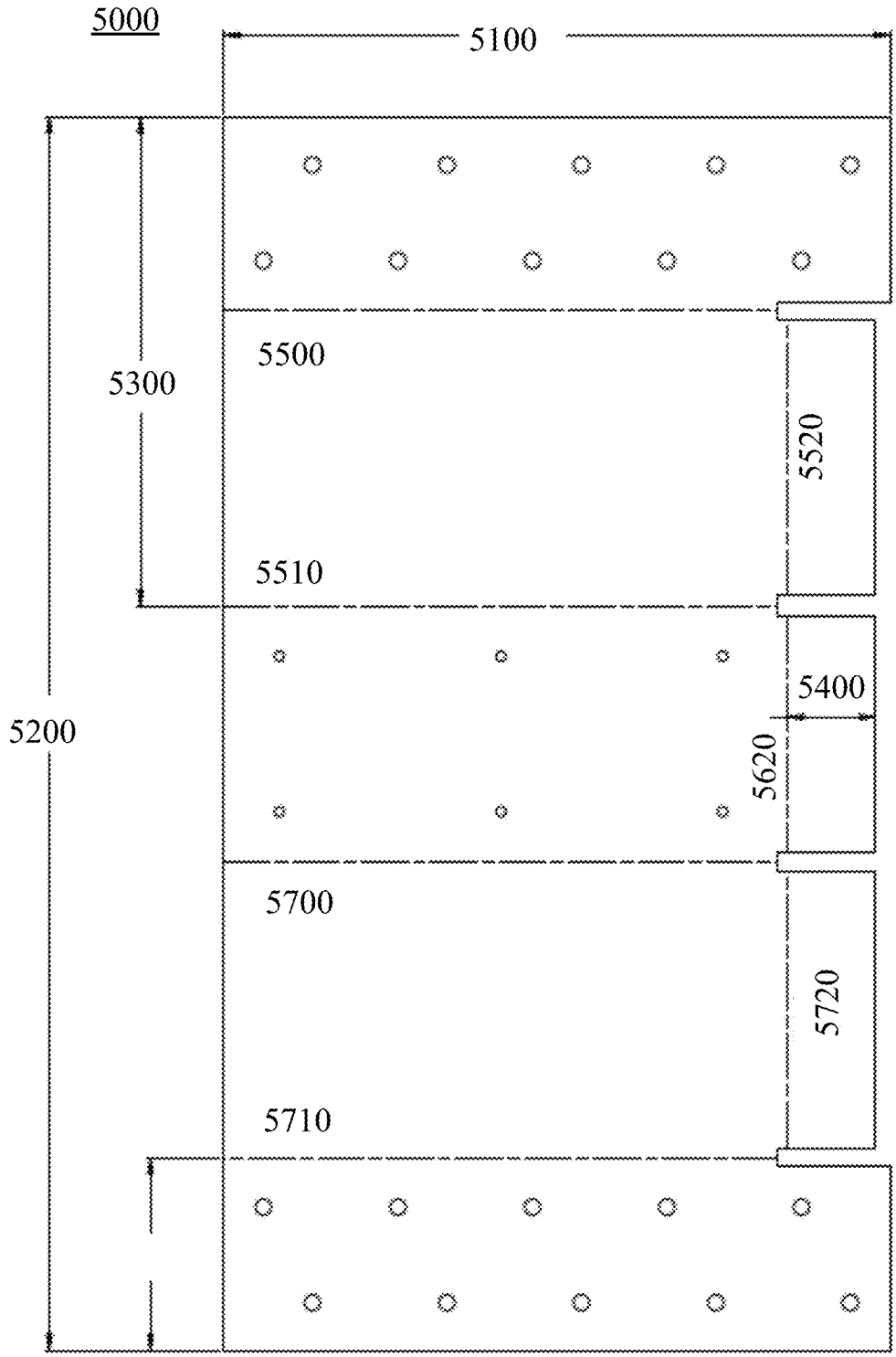
FIG. 5 is a plan view prior to bending of an exemplary embodiment of a system 5000.

FIG. 5 is a plan view prior to bending of an exemplary embodiment of a system 5000. The exemplary embodiment illustrated has a width 5100, a length 5200, a dimension 5300 and a supporting lip width 5400. System 5000 can be bent utilizing a brake (i.e., a metalworking machine that allows the bending of sheet metal). At bend locations 5500, 5620, and 5710 the brake can bend system 5000 upward by approximately ninety degrees relative to a horizontal plane illustrated in FIG. 5. At bend locations 5510, 5520, 5700, and 5720 the brake can bend system 5000 downward by approximately ninety degrees relative to a horizontal plane illustrated in FIG. 5. In one exemplary embodiment, width 5100 can be approximately 10.5 inches; length 5200 can be approximately 19.35 inches, and dimension 5300 can be approximately 7.67 inches, and supporting lip width 5400 can be approximately 1.38 inches. In other embodiments, other dimensions can be utilized to be compatible with deck component dimensions for a desired deck.

Figure 6:
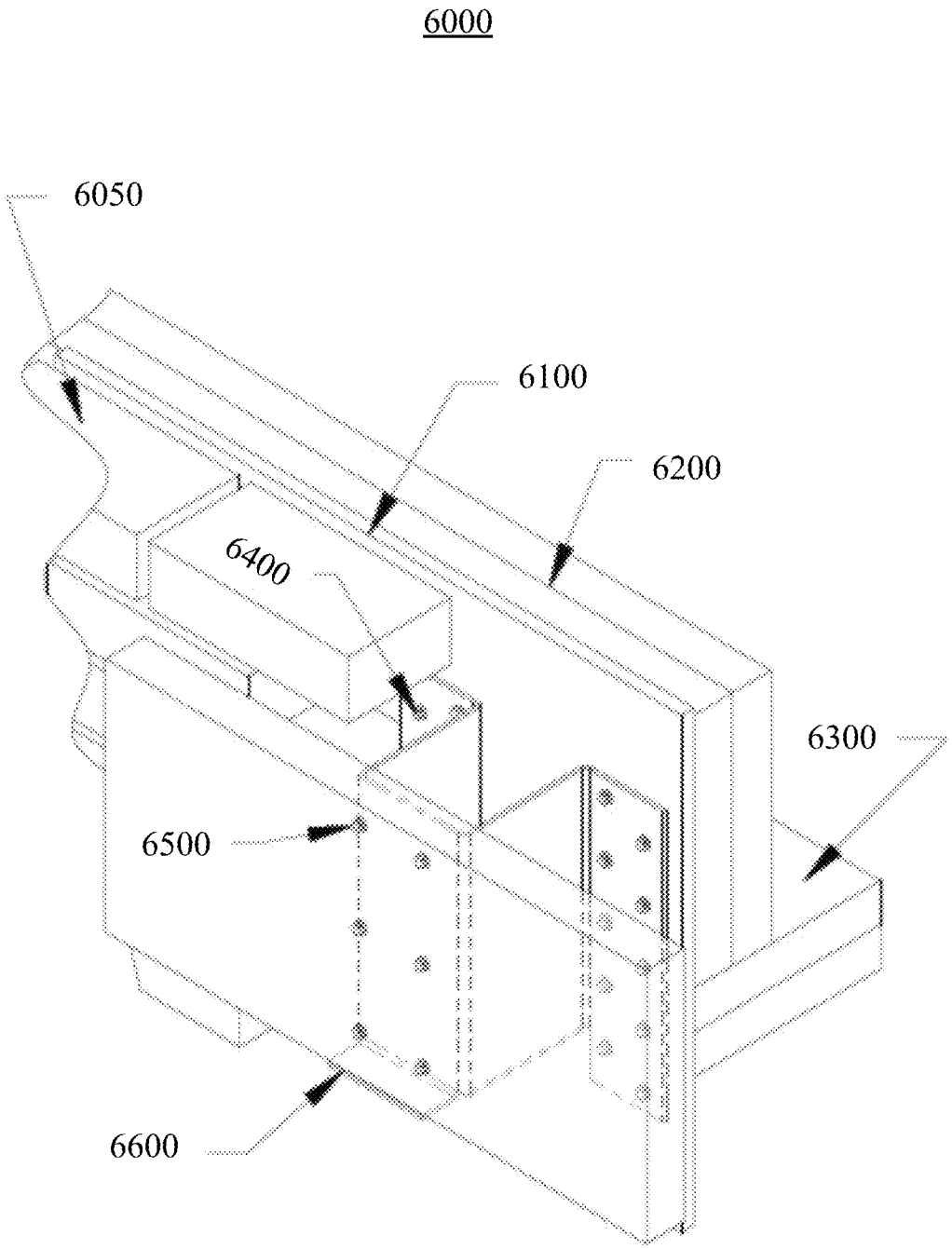
FIG. 6 is an perspective view of an exemplary embodiment of a system 6000.

FIG. 6 is an perspective view of an exemplary embodiment of a system 6000, which comprises:

a deck veneer piece 6050;

wood sheathing 6100;

double 2× wood blocking 6200;

double 2× plate 6300;

Simpson (Simpson is a trademark of the Simpson Strong-Tie Company

Inc. of Pleasanton, Calif.) SDS screws 6400;

Elco (Elco is a registered trademark of Asia Fastening Inc. of Decorah, Iowa) screws 6500; and deck bracket 6600 according to an exemplary embodiment.

FIG. 7 is an sectional view of an exemplary embodiment of a system 7000, which comprises deck sheath 7100, exemplary deck bracket 7200, Simpson SDS screws 7300 (which are staggered), and a 2× wood framed wall 7400.

Figure 8:
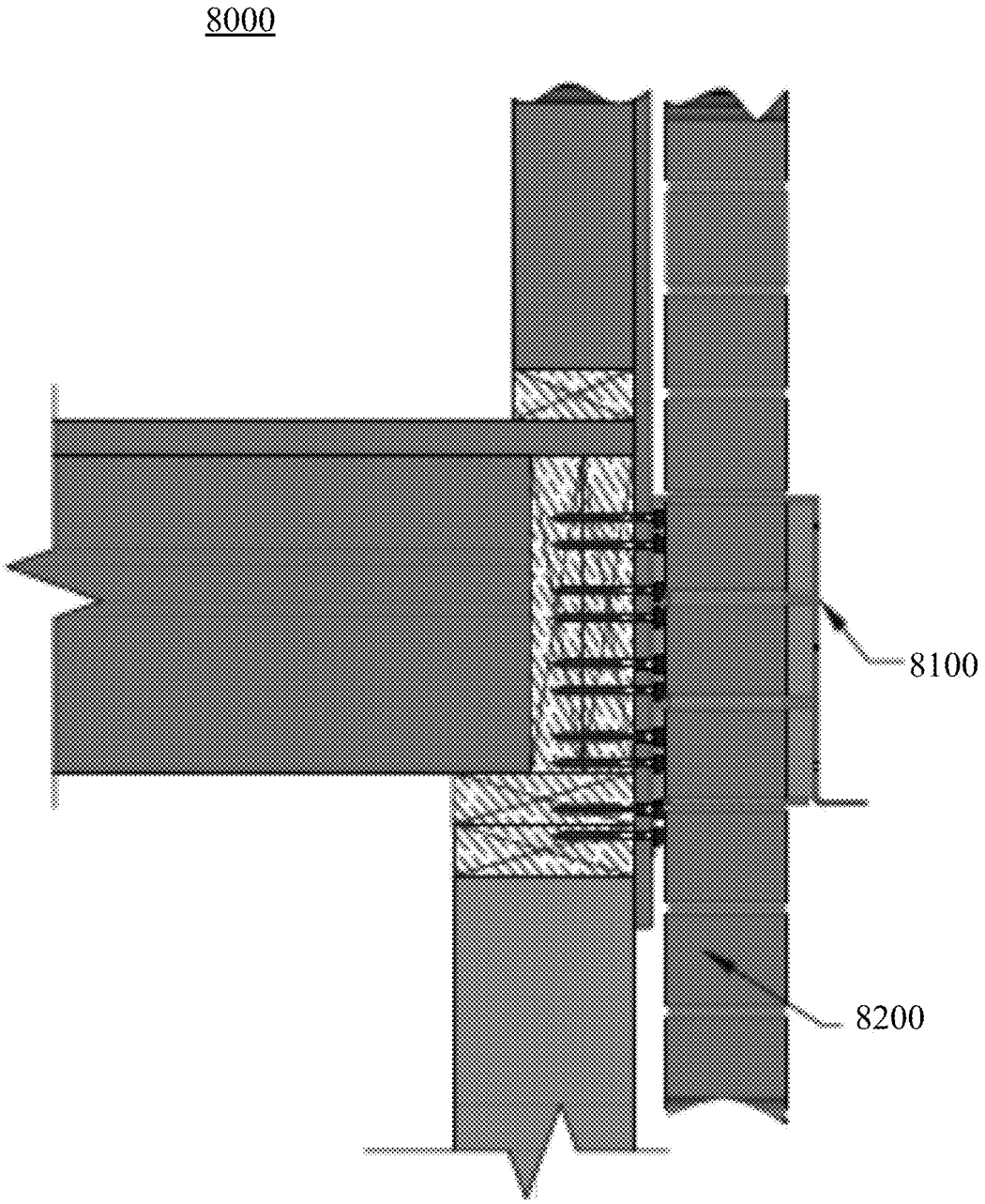
FIG. 8 is a sectional view of an exemplary embodiment of a system 8000.

FIG. 8 is a sectional view of an exemplary embodiment of a system 8000, which comprises an exemplary deck bracket 8100 and masonry veneer 8200.

FIG. 9 is a sectional view of an exemplary embodiment of a system 9000, which comprises a deck band 9100 (e.g., a 2× deck ledger) and a self tapping screw 9200 that couples deck band 9100 to an exemplary deck bracket 9300. System 9000 further comprises a masonry veneer 9400.

Figure 10:
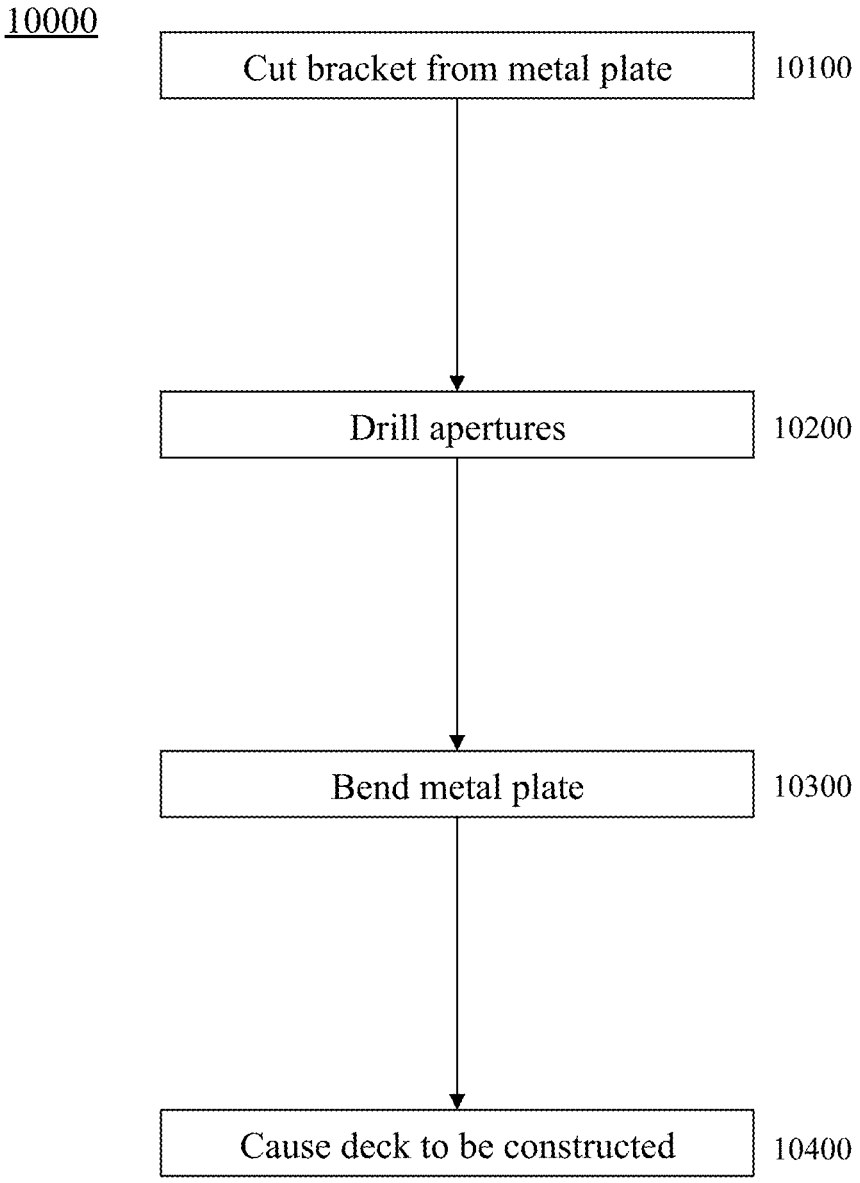
FIG. 10 is a flowchart of an exemplary embodiment of a method 10000.

FIG. 10 is a flowchart of an exemplary embodiment of a method 10000. At activity 10100, a deck bracket can be cut and/or punched from a metal plate. At activity 10200, apertures can be drilled in the deck bracket. At activity 10300, the metal plate can be bent in a brake to form the deck bracket.

At activity 10400, a deck can be caused to be constructed. The deck comprises a deck bracket, which comprises:

a bracket face, the bracket face substantially planar and defining a first plane, the bracket face defining a first plurality of apertures;

a first bracket wall that directly contacts the bracket face, the first bracket wall substantially planar and defining a second plane, the first bracket wall lacking apertures, the first plane substantially perpendicular to the second plane;

a second bracket wall that directly contacts the bracket face, the second bracket wall substantially planar and defining a third plane, the second bracket wall lacking apertures, the first plane substantially perpendicular to the third plane;

a first bracket flange that directly contacts the first bracket wall, the first bracket flange substantially planar and defining a fourth plane, the first bracket flange defining a second plurality of apertures, the fourth plane substantially perpendicular to the second plane;

a second bracket flange that directly contacts the second bracket wall, the second bracket flange substantially planar and defining a fifth plane, the second bracket flange defining a third plurality of apertures, the fifth plane substantially perpendicular to the third plane; and a supporting lip that directly contacts the bracket face, the supporting lip substantially planar and defining a sixth plane, the supporting lip lacking apertures, the first plane substantially perpendicular to the sixth plane.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

and/or—either in conjunction with or in alternative to.

aperture—an opening or hole defined by an object surface.

apparatus—an appliance or device for a particular purpose associate—to join, connect together, and/or relate.

band—a relatively thin strip of material.

bracket—a device coupleable to a surface that supports a component.

can—is capable of, in at least some embodiments.

cause—to produce an effect.

comprising—including but not limited to.

configure—to make suitable or fit for a specific use or situation.

connect—to join or fasten together.

contact—to touch.

constructed to—made to and/or designed to.

coupleable—capable of being joined, connected, and/or linked together.

coupling—linking in some fashion.

create—to bring into being.

deck—a terrace of a building, such as a house.

define—to establish the outline, form, or structure of determine—to obtain, calculate, decide, deduce, and/or ascertain.

device—a machine, manufacture, and/or collection thereof.

directly—substantially without an intervening space.

engage—to be in contact and interact with.

face—a protruding surface of an object.

flange—a projecting rim of an object.

install—to connect or set in position and prepare for use.

lack—to be substantially devoid of lip—a projecting portion of an object.

may—is allowed and/or permitted to, in at least some embodiments.

method—a process, procedure, and/or collection of related activities for accomplishing something.

perpendicular—meeting at substantially right angles.

planar—having a substantially flat surface.

plane—a substantially flat, two-dimensional surface.

plurality—the state of being plural and/or more than one.

predetermined—established in advance.

provide—to furnish, supply, give, and/or make available.

receive—to get, take, acquire, and/or obtain.

set—a related plurality.

sheath—an outer covering of a portion of a deck.

store—to place, hold, and/or retain.

substantially—to a great extent or degree.

support—to bear the weight of, especially from below.

system—a collection of mechanisms, devices, machines, articles of manufacture, processes, data, and/or instructions, the collection designed to perform one or more specific functions.

via—by way of and/or utilizing.

wall—the portion of an object that defines physical limits of the object.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- no characteristic, function, activity, or element is "essential";
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a deck bracket, the deck bracket comprising:

a substantially rectangular bracket face, the bracket face substantially planar and defining a first plane, the bracket face defining a first plurality of apertures;

a first bracket wall that directly contacts the bracket face, the first bracket wall substantially planar and defining a second plane, the first bracket wall lacking apertures, the first plane substantially perpendicular to the second plane;

a second bracket wall that directly contacts the bracket face, the second bracket wall substantially planar and defining a third plane, the second bracket wall lacking apertures, the first plane substantially perpendicular to the third plane;

a first bracket flange that directly contacts the first bracket wall, the first bracket flange substantially planar and defining a fourth plane, the first bracket flange defining a second plurality of apertures, the fourth plane substantially perpendicular to the second plane;

a second bracket flange that directly contacts the second bracket wall, the second bracket flange substantially planar and defining a fifth plane, the second bracket flange defining a third plurality of apertures, the fifth plane substantially perpendicular to the third plane;

a supporting lip that directly contacts the bracket face, the supporting lip substantially planar and defining a sixth plane, the supporting lip lacking apertures, the first plane substantially perpendicular to the sixth plane, wherein a width of the supporting lip and a width of the bracket face are substantially equal;

a first inner lip that directly contacts the first bracket wall, the first inner lip substantially planar and defining a first inner lip plane, the first inner lip lacking apertures, the first inner lip plane substantially perpendicular to the second plane; and a second inner lip that directly contacts the second bracket wall, the second inner lip substantially planar and defining a second inner lip plane, the second inner lip lacking apertures, the second inner lip plane substantially perpendicular to the third plane;

a deck sheath, the deck sheath coupleable to the deck bracket via fasteners engaged with the deck sheath through the second plurality of apertures and the third plurality of apertures, wherein the deck bracket is directly coupleable to the deck sheath without a backing plate therebetween; and a deck band, the deck band coupleable to the deck bracket via fasteners engaged with the deck band through the first plurality of apertures, wherein the supporting lip is constructed to support an edge of the deck band.

2. A system comprising:

a substantially rectangular deck bracket, the deck bracket comprising:

a bracket face, the bracket face substantially planar and defining a first plane, the bracket face defining a first plurality of apertures;

a first bracket wall that directly contacts the bracket face, the first bracket wall substantially planar and defining a second plane, the first bracket wall lacking apertures, the first plane substantially perpendicular to the second plane;

a second bracket wall that directly contacts the bracket face, the second bracket wall substantially planar and defining a third plane, the second bracket wall lacking apertures, the first plane substantially perpendicular to the third plane;

a first bracket flange that directly contacts the first bracket wall, the first bracket flange substantially planar and defining a fourth plane, the first bracket flange defining a second plurality of apertures, the fourth plane substantially perpendicular to the second plane;

a second bracket flange that directly contacts the second bracket wall, the second bracket flange substantially planar and defining a fifth plane, the second bracket flange defining a third plurality of apertures, the fifth plane substantially perpendicular to the third plane;

a supporting lip that directly contacts the bracket face, the supporting lip substantially planar and defining a sixth plane, the supporting lip lacking apertures, the first plane substantially perpendicular to the sixth plane, wherein a width of the supporting lip and a width of the bracket face are substantially equal, wherein the deck bracket is directly coupleable to a deck sheath without a backing plate therebetween, a first inner lip that directly contacts the first bracket wall, the first inner lip substantially planar and defining a first inner lip plane, the first inner lip lacking apertures, the first inner lip plane substantially perpendicular to the second plane; and a second inner lip that directly contacts the second bracket wall, the second inner lip substantially planar and defining a second inner lip plane, the second inner lip lacking apertures, the second inner lip plane substantially perpendicular to the third plane.

3. The system of claim 2, further comprising:

wherein the deck bracket is constructed to be coupled to the deck sheath via a plurality of fasteners engaged with the deck sheath through the second plurality of apertures and the third plurality of apertures.

4. The system of claim 2, further comprising:

a deck band, wherein the deck bracket is constructed to be coupled to the deck band via a plurality of fasteners engaged with the deck band through the first plurality of apertures.

5. A method comprising:

causing a deck to be constructed, the deck comprising a deck bracket, the deck bracket comprising:

a substantially rectangular bracket face, the bracket face substantially planar and defining a first plane, the bracket face defining a first plurality of apertures;

a first bracket wall that directly contacts the bracket face, the first bracket wall substantially planar and defining a second plane, the first bracket wall lacking apertures, the first plane substantially perpendicular to the second plane;

a second bracket wall that directly contacts the bracket face, the second bracket wall substantially planar and defining a third plane, the second bracket wall lacking apertures, the first plane substantially perpendicular to the third plane;

a first bracket flange that directly contacts the first bracket wall, the first bracket flange substantially planar and defining a fourth plane, the first bracket flange defining a second plurality of apertures, the fourth plane substantially perpendicular to the second plane;

a second bracket flange that directly contacts the second bracket wall, the second bracket flange substantially planar and defining a fifth plane, the second bracket flange defining a third plurality of apertures, the fifth plane substantially perpendicular to the third plane;

a supporting lip that directly contacts the bracket face, the supporting lip substantially planar and defining a sixth plane, the supporting lip lacking apertures, the first plane substantially perpendicular to the sixth plane, wherein a width of the supporting lip and a width of the bracket face are substantially equal, wherein the deck bracket is directly coupleable to a deck sheath without a backing plate therebetween, a first inner lip that directly contacts the first bracket wall, the first inner lip substantially planar and defining a first inner lip plane, the first inner lip lacking apertures, the first inner lip plane substantially perpendicular to the second plane; and a second inner lip that directly contacts the second bracket wall, the second inner lip substantially planar and defining a second inner lip plane, the second inner lip lacking apertures, the second inner lip plane substantially perpendicular to the third plane.

* * * * *